US005440768A

United States Patent [19]

Danin

[11] Patent Number: 5,440,768

[45] Date of Patent: Aug. 15, 1995

[54] COMBINATION BED AND TABLE

[76] Inventor: Colin Danin, 14 Homestead Road, Bedfordview, Johannesburg, Transvaal, South Africa

[21] Appl. No.: 185,042

[22] Filed: Jan. 24, 1994

[30] Foreign Application Priority Data

Feb. 4, 1993 [ZA] South Africa ..... 93/0747

[51] Int. Cl.[6] ..... A47C 17/60; A47C 17/62

[52] U.S. Cl. ..... 5/4; 5/3

[58] Field of Search ..... 5/4, 3, 5, 6

[56] References Cited

U.S. PATENT DOCUMENTS 913,032 2/1909 McGaw ..... 5/4
3,077,612 2/1963 Sevcik ..... 5/6
3,638,249 2/1972 Katsigarakis ..... 5/6
4,277,856 7/1981 Danin ..... 5/3

FOREIGN PATENT DOCUMENTS 1420296 10/1965 France ..... 5/4
1420298 10/1965 France ..... 5/3

*Primary Examiner*—Alexander Grosz
*Attorney, Agent, or Firm*—Young & Thompson

[57] ABSTRACT

A combination bed and table which has two outer planar members and one inner planar member which in a first position form a horizontal bed surface with the members in a co-planar relationship and which are relatively movable to a second position at which the outer members are spaced apart and substantially vertical, and the inner member is horizontal and lower than in the first position.

4 Claims, 2 Drawing Sheets

COMBINATION BED AND TABLE

BACKGROUND TO THE INVENTION

This invention relates to a combination bed and table.

The specification of the applicant's U.S. Pat. No. 4,277,856 describes an article of furniture which comprises first and second support members and at least one planar member supported by at least one of the support members. The support members are movable between first positions at which the planar member is substantially horizontally and forms a working top, and second positions at which the support members provide at least part of a sleeping surface.

The aforementioned American patent specification illustrates in FIGS. 2 and 3 two preferred embodiments. In the FIG. 2 embodiment use is made of filler cushions or a bridging piece to ensure that the sleeping surface which is formed by a number of cushions is substantially co-planar.

In the FIG. 3 embodiment a connecting piece which is positioned between the two support members is brought to a co-planar relationship with the support members when the article of furniture is in a bed mode. However this particular feature, which is most desirable, is only achieved at the expense of a deviation from standard dimensions of the bed or table. Thus it has been found that the connecting piece has a relatively narrow dimension which leads to the overall length of the bed being reduced to a shorter bed length than is normally acceptable. If the lengths of the support members are increased to compensate for this reduction then the article of furniture, when in the table mode, has a height which is greater than the standard accepted height.

On the other hand if the two support members have standard heights which are acceptable when in the table mode and the width of the connecting member is increased so that the overall length of the bed is an acceptable standard length then, when the article of furniture is in the table mode, the width of the pedestal which supports the planar member which acts as a working top, is too great and it is not possible to be comfortably seated at the table, because of inadequate leg room.

SUMMARY OF THE INVENTION

The present invention is concerned with a combination bed and table which can be manufactured to acceptable dimensions and which can easily be converted between a table mode and a bed mode without additional components being required.

The invention provides a combination bed and table which includes first and second support members, a bridging member between the support members, connection means which connects the bridging member to the support members, and a planar member attached to one of the support members, the support members being movable between a table mode at which the support members are substantially vertical, the planar member is substantially horizontal thereby forming a working top, and the bridging member is at a first position, and a bed mode at which the planar member is substantially vertical, the support members are substantially horizontal and co-planar, and the bridging member is elevated from the first position, by the connection means, to be co-planar with the support members.

A 'working top', as used herein, is intended to include a table surface.

The connection means may include at least one link which is pivotally connected to each support member.

The link may extend between the support members parallel to the bridging member. Due to the action of the connection means the distance between the bridging member and the link may be varied when the support members are moved between the bed mode and the table mode.

The connection means may comprise a connection between each support member and the bridging member which permits at least limited pivotal and sliding movement of the bridging member relatively to the support member.

The bridging member, at each of two opposed ends, may have two slots and each slot may have engaged with it a pin which extends from the respective support member and which is slidable and pivotal relatively to the slot.

Each pin may be elevated, when the support members are in the bed mode, to a position which is higher than the link.

BRIEF DESCRIPTION OF THE DRAWINGS

The invention is further described by way of example with reference to the accompanying drawings in which.

DESCRIPTION OF PREFERRED EMBODIMENT

Figure 1:
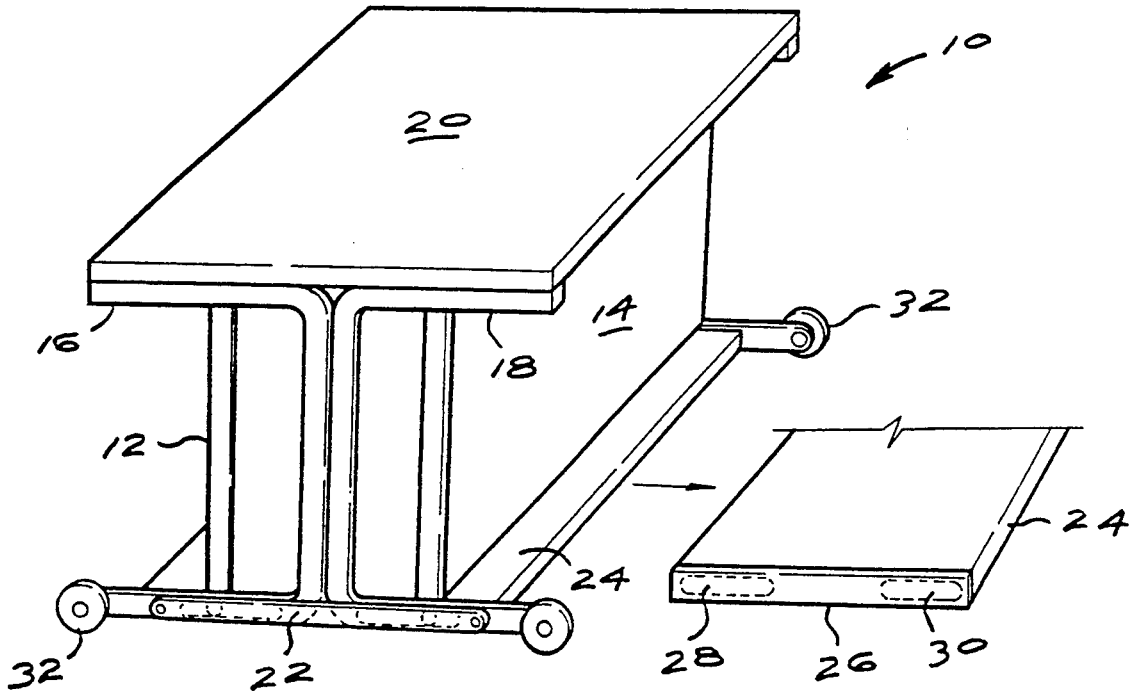
FIG. 1 is a perspective view of a combination bed and table according to the invention in a table mode.
Figure 2:
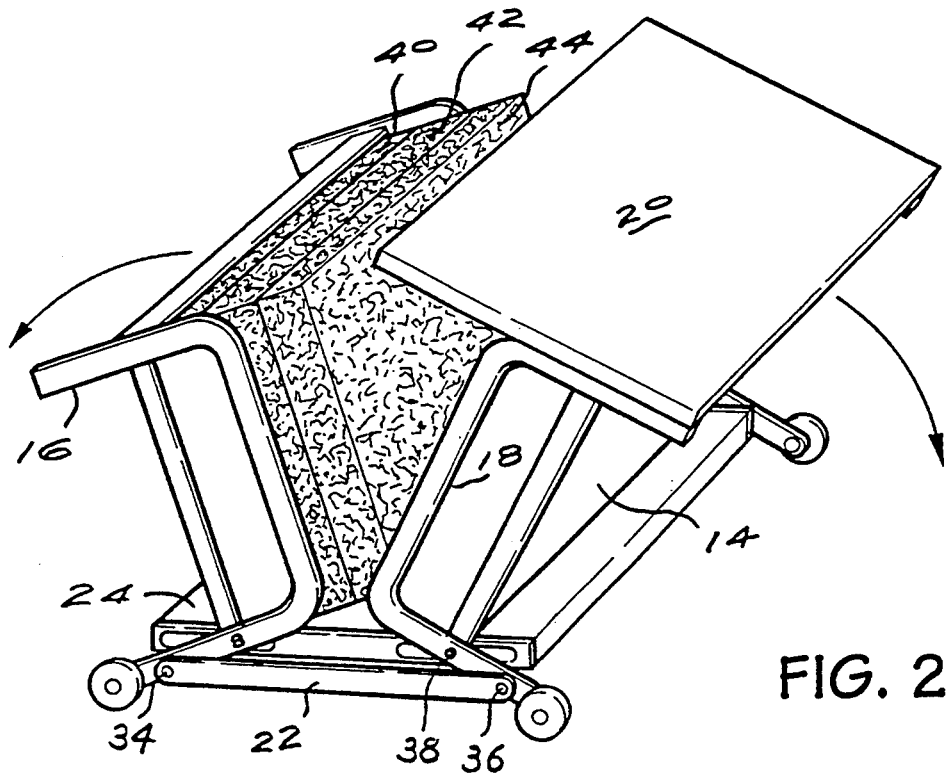
FIG. 2 illustrates the combination of FIG. 1 in the course of being adjusted to a bed mode.

The drawings illustrate a combination bed and table 10 which includes two support members 12 and 14 which are mounted to respective U-shaped steel frames 16 and 18, a planar member 20 which is fixed to the frame 18, links 22 on opposed sides of the frames 16 and 18, although only one link is visible in the drawings, and a bridging member 24, shown in greater detail in the inset drawing in FIG. 1.

The components 12, 14, 20 and 24 are made from any suitable material such as chipboard, particle board or the like.

The member 24 has end pieces 26 with longitudinally extending slots 28 and 30.

The frames 16 and 18 have wheels 32.

Each link 22 is pivotally mounted at points 34 and 36 to the frames 16 and 18. Each frame has two pins 38 which are slidably and pivotally engaged with the slots 28 and 30.

Figure 3:
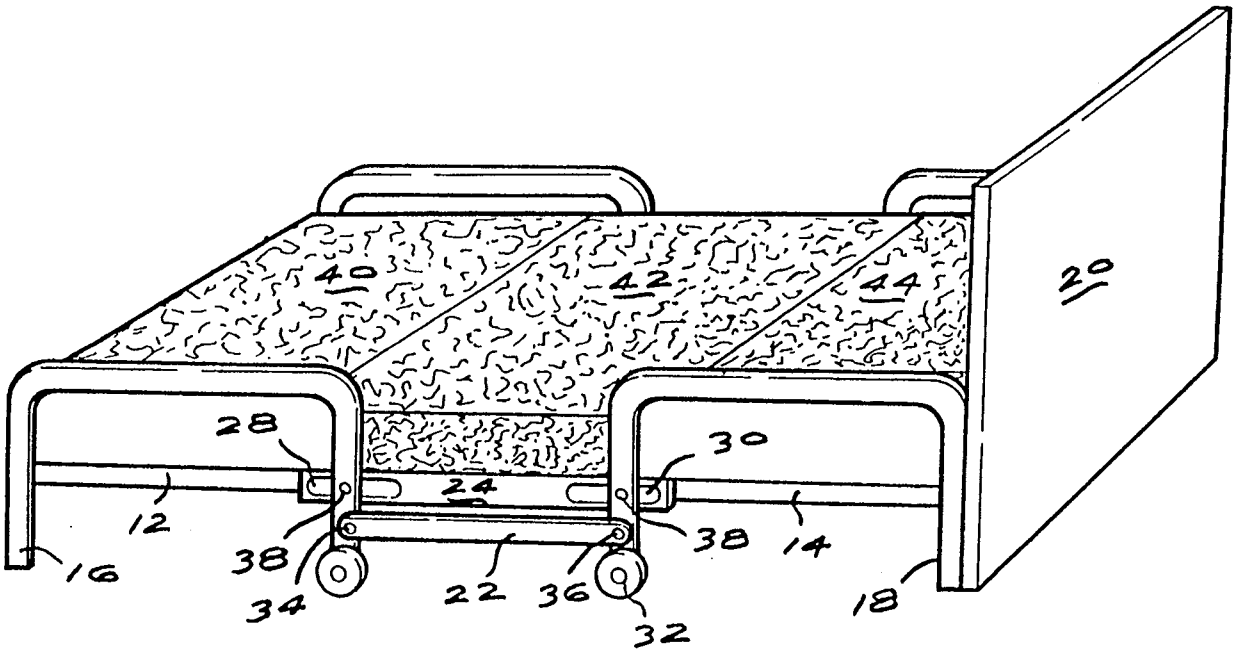
FIG. 3 shows the combination bed and table in a bed mode.

The support members 12 and 14 form a cavity which contains foam mattress sections 40, 42 and 44 which are linked to one another in a three-way fold. As the combination is moved to the bed mode of FIG. 3 it is possible to access the mattress sections which can be unfolded to form a continuous bed surface as shown in FIG. 3.

In the table mode the bridging member 24 and the links 22 are at lowermost positions substantially adjacent the floor. Because the pivot points 34 and 36 are spaced from the pivot points 38 relative movement between the links and the bridging member takes place when the combination is moved to the bed mode. As the support members 12 and 14 move apart, the gap between them increases. The links move down away from the bridging member which moves upwardly into the gap between, and co-planar, with the support members. The mattress sections 40 to 44 thus provide a continuous bed surface.

The relative movement between the support members 12 and 14, the bridging member 24 and the links 22, makes it possible to design the combination so that its dimensions, when in the bed or table mode, are acceptable for normal usage.

I claim:

1. A combination bed and table which includes first and second frame means, said first and second frame means comprising first and second support members respectively, at least one link which is pivotally connected to the frame means, a bridging member between the frame means, connection means which connects the bridging member to the frame means, the connection means providing a connection between each frame means and the bridging member which permits pivotal and sliding movement of the bridging member relatively to the respective frame means, and a planar member attached to one of the frame means, the frame means and the support members being movable between a table mode at which the support members are substantially vertical, the planar member is substantially horizontal thereby forming a working top, and the bridging member is at a first position, and a bed mode at which the planar member is substantially vertical, the support members are substantially horizontal and co-planar, and the bridging member is elevated from the first position by the connection means, to be co-planar with the support members.

2. A combination bed and table according to claim 1, wherein at each of two opposed ends the bridging member has two slots and each slot is engaged with a pin which extends from a respective frame means and which is slidable and pivotal relatively to the slot.

3. A combination bed and table according to claim 2, wherein each pin is elevated, when the frame means and the support members are in the bed mode, to a position which is higher than the link.

4. A combination bed and table which includes first and second support members, a bridging member which is pivotally and slidably connected to the support members, at least one link which is pivotally connected to each support member, and a planar member attached to one of the support members, the support members being movable between a table mode at which the support members are substantially vertical, the planar member is substantially horizontal thereby forming a working top, and the bridging member is at a first position, and a bed mode at which the planar member is substantially vertical, the support members are substantially horizontal and co-planar, the bridging member is elevated from the first position, sliding and pivoting relatively to the support members, to be co-planar with the support members, and the link is moved downwardly relatively to the bridging member.

* * * * *